US006425237B1

(12) United States Patent
Greifeneder et al.

(10) Patent No.: US 6,425,237 B1
(45) Date of Patent: Jul. 30, 2002

(54) SEWING YARN AND PROCESS FOR THE MANUFACTURE OF A SEWING YARN

(75) Inventors: Karl Greifeneder; Kurt Truckenmueller, both of Heilbronn (DE)

(73) Assignee: Amann & Soehne GmbH & Co., Boennigheim (DE)

( * ) Notice: Subject to any disclaimer, the term of this patent is extended or adjusted under 35 U.S.C. 154(b) by 0 days.

(21) Appl. No.: 09/526,373

(22) Filed: Mar. 16, 2000

(30) Foreign Application Priority Data

Mar. 16, 1999 (DE) ..... 199 11 757

(51) Int. Cl.[7] ..... D02G 03/36

(52) U.S. Cl. ..... 57/211; 57/210; 57/224; 57/225; 57/226; 57/227; 57/228; 57/236; 57/237; 57/238; 57/239; 57/243; 57/244; 57/245; 57/246; 57/248

(58) Field of Search ..... 57/5, 211, 224, 57/225, 226, 227, 228, 236, 237, 238, 239, 243, 244, 245, 246, 248

(56) References Cited

U.S. PATENT DOCUMENTS 4,495,760 A * 1/1985 Vanhelle ..... 57/211

* cited by examiner

*Primary Examiner*—John J. Calvert
*Assistant Examiner*—Shaun R Hurley
(74) *Attorney, Agent, or Firm*—Dick and Harris

(57) ABSTRACT

A sewing yarn is described, with at least two roving. yarns, which are twisted together with one another for the formation of the sewing yarn, whereby each roving yarn has the structure of a core yarn, comprising at least one first multifilament yarn component, forming a yarn core, and a second fiber yarn component spun over the core. In the cross-section of the sewing yarn, the spun fiber yarn covering of at least one roving yarn contains less than 41 individual fibers.

24 Claims, No Drawings

SEWING YARN AND PROCESS FOR THE MANUFACTURE OF A SEWING YARN

BACKGROUND OF THE INVENTION

1. The Technical Field

The present invention relates to a sewing yarn with at least two roving yarns, which are twisted together with one another to form the sewing yarn, whereby each roving yarn has the structure of a core yarn, which comprises at least one first multifilament yarn component forming a core, and a second fibre yarn component spun over the core, and a process for the manufacture of such a sewing yarn in which at least two roving yarns are initially manufactured, whereby, to produce each of the yarns, a slubbing made of fibre yarns is introduced into a spinning device together with the multifilament yarn component serving as the core, and is spun in said spinning device, and the at least two roving yarns are then twisted together with one another.

2. The Prior Art

Sewing yarns are known in a variety of different structures, whether as sewing thread, as air-intermingled yarns, or as core yarns, whereby each of the structures referred to has its individual advantages and weaknesses respectively.

Sewing yarns which are designed as core yarns comprise at least two roving yarns, whereby these roving yarns, at least two in number, designed as core yarns, are processed by twisting to make finished sewing yarn. Each of these roving yarns in this situation has the structure of a core yarn, of such a nature that each roving yarn encompasses at least one core made of a first multifilament yarn component, whereby this core is then spun with a second fibre yarn component. In other words, a roving yarn of this type has a core- enveloping fibre or sheath structure, whereby the core is formed by the interior multifilament core, designated hereinafter as the first core component, and the sheath is formed by a fibre yarn which surrounds the core and is designated hereinafter as the second yarn component or the second fibre yarn component.

Because the second fibre yarn component or the sheath component in such known core yarns is intended to cover the first multifilament yarn component, which provides a major part of the strength of the finished sewing yarn, to provide protection against undesirable damage during sewing, persons skilled in the art have hitherto considered it necessary for such thread covering with fibre yarn to be necessarily so dense that the sewing yarn created from two roving yarns must feature, viewed in the cross-section of the sewing yarn, at least about 45 individual fibres per roving yarn, but as a rule between 50 and 88 individual fibres per roving yarn. This leads to a situation, however, in which such core yarns can only be manufactured with relatively high costs expenditure, due to the relatively high usage of fibre yarn.

The object underlying the present invention is to provide a sewing yarn of the type described, which comprises the structure of a core yarn, and which can be manufactured in a more economical manner than hitherto.

SUMMARY OF THE INVENTION

This object is achieved according to the invention by a sewing yarn with at least two roving yarns, which are twisted together with one another to form the sewing yarn, whereby each roving yarn has the structure of a core yarn, which comprises at least one first multifilament yarn component forming a core, and a second fibre yarn component spun over the core, characterized in that, viewed in the cross-section of the sewing yarn, the spun fibre yarn covering of at least one roving yarn contains less than 41 individual fibres.

DETAILED DESCRIPTION OF THE INVENTION

The sewing yarn according to the invention consists, in the same manner as the known sewing yarn described heretofore, of at least two roving yarns, which are twisted together to form the sewing yarn. Each roving yarn in this situation has the structure of a core yarn, whereby this core yarn comprises at least one first multifilament yarn component, forming the core, and a second fibre yarn component surrounding respectively spinning over the core. Viewed in the cross-section of the ready to use sewing yarn, with the sewing yarn according to the invention, the fibre yarn spinn over which is later on also called thread covering of the at least one roving yarn comprises a maximum of 41 individual fibres, and for preference less than 41 individual fibres, so that accordingly, in comparison with the prior art described heretofore, the sewing yarn according to the invention has a considerably lower number of fibre yarns in the fibre yarn thread covering which forms the sheath of the roving yarns. In other words, the sewing yarn according to the invention accordingly differs from conventional sewing yarn in that the sewing yarn according to the invention comprises at least one roving yarn, in which the fibre yarn spinn over the at least one roving yarn contains decidedly fewer individual fibres than is the case with the prior art.

Surprisingly, it was discovered that the sewing yarn according to the invention, despite the reduced number of individual fibres in the fibre thread covering of the roving yarn or roving yarns comprises even better sewing properties in comparison with other identical but conventional sewing yarns. This is all the surprising, since persons skilled in the art have formerly assumed the minimum individual fibre count referred to heretofore as the prior art, to be at least 45 individual fibres per roving yarn, in order to guarantee adequate coverage and adequate protection of the multifilament yarn components forming the core of the roving yarn. The improved sewing behaviour of the sewing yarn according to the invention, expressed in up to 15% higher sewing speeds or up to 20% longer seams in multidirectional sewing and a high number of button holes without thread breakage produced with the sewing yarn according to the invention, is attributed to the fact that the fibre yarn thread covering of the roving yarn, provided for with the sewing yarn according to the invention, with a maximum of 41 individual fibres or for preference fewer (viewed across the cross-section of the ready to use sewing yarn) on the one hand still provides adequate protection for the multifilament core of each roving yarn against mechanical and/or thermal damage, and, on the other, leads to increased structuring because of the reduced individual fibre count in the thread covering, with the result that more air is drawn in by means of such a thread covering, which is reduced in relation to the individual fibre count, as a result of which an improved cooling effect is achieved of the thread guide elements or the needles, which are heated up as a result of the industrial sewing process. Likewise, as a result of a reduction in the individual fibres in the fibre thread cover, the hairiness is reduced, and the risk also reduced of protruding ends of individual fibres becoming caught on the needles or on the thread guide elements, and so incurring a thread breakage during sewing. In addition, the sewing yarn according to the invention also has a substantially reduced thickness, because of the reduction in the number of individual fibres in the fibre yarn thread covering of the minimum of one roving yarn in comparison with a conventional sewing yarn, which has at least 45 individual fibres in the fibre yarn thread covering, with the result that finer seams can also be produced with the sewing yarn according to the invention than was hitherto possible with conventional core yarn. Due to the fact that the sewing yarn according to the invention also requires less use of material due to the reduced individual fibre count in the fibre yarn thread covering, the sewing yarn according to the invention can be produced correspondingly more cheaply than a conventional core yarn. This advantage is emphasised still further with the sewing yarn according to the invention in that, during the spinning over of the roving yarn, only a small volume of material needs to be processed to make fibre yarn, with the result that the manufacturing speeds of the sewing yarns according to the invention can be increased accordingly, in comparison with the manufacturing process of conventional sewing yarns, for preference by between 5% and some 15%.

In order to measure the number of individual fibres with the sewing yarn according to the invention, as provided for in the fibre yarn thread covering of the minimum of one roving yarn, in a reproducible and unambiguous manner, five cross-sections are prepared over a length of 2 meters of the ready to use sewing yarn, with the result that, on the basis of these cross-sections, the fibre yarn thread covering can be microscopically counted in respect of its individual fibre count. This process is then repeated four times in each case after unwinding 50 meters, with the result that 25 cross-sections are then microscopically evaluated accordingly, from which a mean value can accordingly be acquired for the individual number of fibres of the fibre yarn thread covering.

A particularly well-suited embodiment of the sewing yarn according to the invention makes provision for the fibre yarn thread covering of all the roving yarns in this situation, viewed in the cross-section of the sewing yarn, to have a maximum of 41 individual fibres, but for preference less than 41. In other words, with this preferred embodiment of the sewing yarn according to the invention, the sewing yarn is formed by such roving yarns being twisted together in which the individual fibre count of the thread covering is limited to a maximum of 41 individual fibres, and for preference fewer. A sewing yarn of this type will then have the advantages referred to heretofore in comparison with a conventional sewing yarn of otherwise identical structure, to a particular degree, and will also have an extremely low thickness without the technical sewing properties being thereby impaired in any way at all.

Surprisingly, it has been discovered that a particularly suitable embodiment, outstandingly well-suited for many sewing operations, can be provided by this embodiment of the sewing yarn according to the invention comprising at least one such roving yarn, with which the fibre yarn thread covering, viewed in the cross-section of the sewing yarn, has an individual fibre count of between 20 individual fibres and 38 individual fibres. If this embodiment of the sewing yarn according to the invention is manufactured exclusively from such roving yarns in which the fibre yarn thread covering of all the roving yarns, viewed in the cross-section of the sewing yarn, comprises between 20 individual fibres and 38 individual fibres, then such an embodiment of the sewing yarn according to the invention will have even more greatly improved sewing properties and can, in addition, be manufactured with a reduction in the material used and with a further increase in manufacturing speed.

In order to optimise the hairiness of the sewing yarn according to the invention still further, and also to increase the sewing performance even more, one particularly advantageous embodiment of the sewing yarn according to the invention makes provision in this situation for the individual fibres of the fibre yarn thread covering of each roving yarn to have a mean staple length of between 25 mm and 70 mm, and for preference between 33 mm and 43 mm.

A particularly advantageous situation can be created for the achievement of the covering of the multifilament core of each sewing yarn according to the invention, as described in the preamble, is when the total fineness of the fibres used for the fibre yarn thread covering of a roving yarn varies between 25 dtex and 200 dtex.

In particular, the sewing yarn according to the invention has such roving yarns as possess a total fineness of between 70 dtex and 400 dtex, whereby these roving yarns, formed as core yarns, then contain, in addition to the multifilament core, also the fibre yarn thread covering, forming a sheath, with a maximum individual fibre count of 41 individual fibres and, in particular, less than 41 individual fibres.

A particularly good correlation between the thickness of the sewing yarn according to the invention and the desired properties is attained when the sewing yarn according to the invention consists of two to four roving yarns of the type described heretofore or still to be described hereinafter, which are twisted together with one another to form the sewing yarn. A sewing yarn of this type then has in particular a total fineness, as a ready to use yarn, of between 140 dtex (2×70 dtex) as a minimum, and, in particular, a maximum titre of 1,600 dtex (4×400 dtex), and is especially suitable for almost all sewing operations which may arise.

One particularly high-strength embodiment of the sewing yarn according to the invention is obtained when the first multifilament yarn component forming the core of each roving yarn, or the core of at least one roving yarn, is made of polyester, and in particular of high-strength polyester. This term is to be understood in particular to mean such a polyethylene terephthalate which is also available under the conventional commercial designation of high-strength technical polyester fibres, whereby, in this case, the intrinsic viscosity varies in particular between 0.5 dl/g and 0.75 dl/g, and for preference between 0.55 dl/g and 0.63 dl/g. In this situation, this intrinsic viscosity is determined in appropriate polymer solutions in dichloroacetic acid at 25° C.

With regard to the individual filament titre of the first multifilament yarn component provided for as the core in each roving yarn, it is to be specified that this value varies in particular between 1 dtex and 6 dtex, and for preference between 1.5 dtex and 3 dtex.

For preference, the sewing yarn according to the invention comprises such roving yarns in which the first multifilament yarn component, which forms the core of each roving yarn, has a filament count of between 16 and 300 in particular, and for preference an individual filament count of between 24 and 96.

A particularly advantageous sewing behaviour comprises such embodiments of the sewing yarn according to the invention, in which the second yarn component, which forms the thread covering of each roving yarn, is a fibre yarn made of polyester fibres and/or of cellulosic fibres, and of cotton fibres in particular. In this situation, if a polyester fibre is used as the fibre yarn for the thread covering, then this offers the additional advantage in comparison with the embodiments of the sewing yarn according to the invention which have a thread covering of cellulosic fibres, that a sewing yarn of this type then consists exclusively of polyester, and can therefore be dyed in a single-stage process, making use of one class of dye, namely dispersion dyes.

The term polyester in this text is to be understood to mean such fibres or filaments, which consists exclusively or largely of polyethylene terephthalate.

A particularly good and less hairy covering is ensured with such an embodiment of the sewing yarn according to the invention, with which such fibres are selected for the thread covering of each roving yarn of which the individual fibre titre varies between 0.6 dtex and 4 dtex, and in particular between 0.8 dtex and 2 dtex.

Fibres, fibre yarns, or staple fibres in the meaning of the present application are intended to designate all such concurring structures of fibre form which have a limited length, and in particular a length of between 25 mm and 70 mm.

In particular, each roving yarn in the roving yarn according to the invention has a mass ratio of the first yarn component to the second fibre yarn component which makes up the thread covering of the first yarn component serving as the core, of 50:50 to 75:25, and for preference of 58:42 to 68:32.

A particularly well-suited and easily-dyed embodiment of the sewing yarn according to the invention makes provision for each roving yarn in this situation to have a first yarn component, i.e. a core material, which is identical in terms of material, and which is spun with a fibre yarn thread covering which is identical in terms of material. In other words, with this embodiment, each roving yarn and each fibre yarn thread covering allocated to the roving yarn may be made of polyester, for example, so that this sewing yarn, consisting entirely of polyester, can then be dyed with dispersion dyes in one operating stage.

In particular in cases in which the specific strength of each roving yarn varies between 40 cN/tex and 55 cN/tex, a sewing yarn according to the invention manufactured from these roving yarns has a extreme high strength, with the result that it is well-suited for almost all sewing operations.

This comment also applies to such embodiments of the sewing yarn according to the invention in which, for preference, the absolute strength of the roving yarn varies between 320 cN and 2,400 cN.

Independently of the specific and absolute strength values of the roving yarns indicated heretofore, which are reflected in corresponding and almost identical strength values of the ready to use sewing yarns, it is particularly suitable and advantageous if the sewing yarn according to the invention is made of such roving yarns of which the loop strength is between 60% and 70% of the absolute strength and/or the strength values indicated heretofore. It has also been shown in this situation that embodiments of the sewing yarn according to the invention made from roving yarns of this type then likewise provide a loop strength of between 60% and 70% of the absolute strength values of the sewing yarns, so that embodiments of the sewing yarn according to the invention of this kind are especially preferred.

In order to measure this loop strength, in each case two interlacing loops of the roving yarn are tensioned in a breaking force measuring device, and subjected to a load, while measuring the force, until a breaking occurs in the roving yarn or the sewing yarn respectively.

The present invention further refers to a process for the manufacture of the embodiments of the sewing yarn according to the invention as described heretofore.

With the process according to the invention for the manufacture of the sewing yarn according to the invention, first at least two roving yarns are produced, whereby, for the production of each roving yarn, a slubbing made of fibre yarns is introduced into a spinning device together with the multifilament yarn component serving as the core, and is spun in said spinning device. At least minimum two roving yarns produced in this way, which are core yarns, are twisted together, as a result of which the roving yarn according to the invention is formed. As a departure from the prior art, with the process according to the invention the slubbing of the fibre yarn is compacted directly before being introduced into the spinning device to such an extent that in the ready to use sewing yarn the fibre yarn thread covering of at least one roving yarn, viewed over the cross-section of the sewing yarn, comprises a maximum of 41 individual fibres, and for preference less than 41 individual fibres, and, in particular between 20 individual fibres and 38 individual fibres. In other words, with the process according to the invention, the slubbing of the fibre yarn (the second yarn component) is compressed to such an extent that a reduced number of fibre yarns are spun together with the multifilament yarn component serving as the core, they being for preference twisted together.

The process according to the invention in principle contains, by analogy, the advantages already described heretofore for the sewing yarn according to the invention, and in order to avoid repetition reference is accordingly made to these advantages at this juncture. In particular, however, it is to be pointed out that the process according to the invention can be applied particularly economically, with savings of materials, that it can be carried out more rapidly than the conventional process, and that the sewing yarn according to the invention, produced thereafter, has excellent and universally-applicable sewing properties, such as have been described in detail heretofore.

In order to achieve the savings on fibres in the fibre yarn thread covering, as described with the sewing yarn according to the invention, one particular option is that the slubbing produced by the process according to the invention is compacted immediately before being introduced into the spinning device to such an extent that it corresponds to 10 to 25 times the volume of the spun roving yarn, and in particular to 15 to 20 times the volume of the spun roving yarn. Due to the fact that the slubbing of the fibre yarn, which is introduced into the spinning device together with the core material, has as a rule only a limited thickness, i.e. in particular a thickness of some 1 to 5 layers of the fibre yarn, the volume of the fibre yarn slubbing can be approximately equated with the width which the fibre yarn roving adopts, so that the remark reproduced heretofore with regard to the compacting approximately accords with the remark hereinafter. This means that, with the process according to the invention, the width assumed by the slubbing is compacted to 10 to 25 times, and in particular to 15 to 20 times, the thickness of the spun roving yarn.

In order to attain the compaction of the slubbing as described heretofore, with the process according to the invention, in a particularly simple and effective manner and without interfering with the production sequence, a particularly advantageous method is provided if this compacting of the slubbing is induced by means of compressed air and/or in particular by means of a vacuum.

The roving yarns manufactured in accordance with the process according to the invention, which in each case are produced by spinning, in particular by the twisting of the multifilament core material with a fibre yarn component while maintaining the individual fibre count indicated heretofore, of a maximum of 41 individual fibres, and for preference of less than 41 individual fibres; these roving yarns are then twisted together with the process according to the invention, so forming the ready to use sewing yarn, whereby a twist factor α is selected between 115 and 160.

In particular, with the process according to the invention, the twist factor α', which is applied for the manufacture of the roving yarn, is between 80 and 130, whereby naturally the direction of rotation selected for the twist torsion is contrary to the direction of rotation of the roving yarn.

The twist factors a and α' respectively, as indicated heretofore, are defined in this context as follows:

$$\text{Twist factor } \alpha \text{ or } \alpha' \text{ respectively} = \frac{\text{Twists per meter}}{\sqrt{Nm}}$$

where Nm is the yarn count (titre), given in metric values (counts).

The sewing yarn according to the invention is explained in detail hereinafter on the basis of one example, in comparison with a standard yarn.

To achieve comparison values, in the first instance a roving yarn was spun according to the conventional process, whereby as raw material for this roving yarn a multifilament core with a titre of 139 dtex was twisted together with a fibre yarn of 65 dtex and a twist coefficient α' of 110 in the S-direction. For this, a mass ratio of filament material (multifilament core) of 68.1% and a fibre yarn proportion (fibre yarn thread covering) of 31.9% was selected, whereby the roving yarn produced then had an effective titre of 204 dtex. This roving yarn had a linear strength of 1,040 cN and a specific strength of 50.98 cN/tex respectively, whereby the loop strength was 676 cN.

The fibres of the fibre yarn covering used had an individual titre of 1.3 dtex and have a staple length of 38 mm.

Both the core material and the staple fibre covering consisted of polyester (polyethylene terephthalate).

Two of these roving yarns, which are core yarns, were then twisted together, to form the ready to use sewing yarn, whereby, for this twisting procedure, which was effected in the Z-direction, a twist factor α of 125 was selected. The ready to use sewing yarn produced in this way, which is designated hereinafter as standard sewing yarn, contained a total denier of 440 dtex.

From this standard sewing yarn cross-sections were prepared, in order to determine the number of fibres of the fibre yarn thread covering of each roving yarn. To do this, five cross-sections were prepared over a length of 2 meters. The number of individual fibres in the fibre yarn thread covering of each roving yarn was then counted by microscopic means. After unwinding 50 meters of standard sewing yarn in each case, this measurement was then repeated four times, with the result that a total of 25 cross-sections were evaluated by microscopic means.

The measurement of the number of fibre yarns in the cross-section of the ready to use standard sewing yarn revealed that the fibre yarn thread covering of each roving yarn had a mean value of 50.17 fibres.

By making use of the same initial materials (both multifilament core material as well as fibre yarn material), a roving yarn was spun in accordance with the claimed process, whereby, directly in front of the spinning device, into which the multifilament core material and the fibre yarn stubbing were introduced together, the fibre yarn slubbing was compacted to 18 times the thickness of the spun roving yarn, making use of a vacuum. For this joint spinning of the multifilament core with the fibre yarn slubbing, a twist factor α a was selected, which corresponds to the twist factor referred to heretofore.

The roving yarn obtained in this way had an effective titre of 188 dtex and a mass distribution of filament to fibre component of 73.9 to 26.1.

The linear strength of the roving yarn produced in this way amounted to 1,060 cN, and the specific strength was 56.38 cN/tex.

The loop strength of the roving yarn was 690 cN.

The roving yarn had an S-rotation.

Two of these roving yarns were twisted together for the formation of the sewing yarn, which is designated hereinafter as sewing yarn E, whereby the twisting was effected in the Z-direction, under the twist factor α indicated heretofore.

The number of fibres on each fibre yarn thread covering of each roving yarn was determined by means of cross-sections and microscopic assessment, whereby the method of determination has been described heretofore.

As a result of this determination of the number of fibres in the fibre yarn thread covering of each roving yarn, it can be stated that, with the sewing yarn E, the number of fibres in the fibre thread covering of each roving yarn amounted on average to 37.69. The ready to use sewing yarn had a total denier of 407 dtex.

Thickness measurements of the standard sewing yarn and of the sewing yarn E revealed that the sewing yarn E featured a 10 % lower thickness in comparison with the standard sewing yarn.

Under more stringent sewing conditions, i.e. with industrial sewing with a sewing speed of 7,000 stitches a minute of a twill cloth, five layers, the sewing behaviour of the standard sewing yarn was compared with the sewing behaviour of the sewing yarn E. In this situation, it was determined that the sewing behaviour of both yarns was good, but the sewing yarn E in comparison with the standard sewing yarn made possible a 15 % longer seam, before thread breakage occurred. This improved sewing behaviour is clear proof of the technical sewing advantage of the sewing yarn E, which differs from the standard sewing yarn solely in the number of fibres in the fibre yarn thread covering of each roving yarn, in the total denier, and in the lower thickness value.

What is claimed is:

1. A sewing yarn with at least two roving yarns, which are twisted together with one another to form the sewing yarn, whereby each roving yarn has the structure of a core yarn, which comprises at least one first multifilament yarn component forming a core, and a second fibre yarn component spun over the core, characterised in that, viewed in the cross-section of the sewing yarn, the spun fibre yarn covering of at least one roving yarn contains less than 41 individual fibres.

2. A sewing yarn according to claim 1, characterised in that the fibre yarn thread coverings of all of the roving yarns, viewed in the cross-section of the sewing yarn, contain fewer than 41 individual fibres.

3. A sewing yarn according to claim 1, characterised in that the fibre yarn thread covering of the roving yarn or the fibre yarn thread coverings of the roving yarns respectively, viewed in the cross-section of the sewing yarn, contains or contain a number of individual fibres of between 20 individual fibres and 38 individual fibres.

4. A sewing yarn according to claim 1, characterised in that the individual fibres of the spun fibre yarn covering have a means staple length of between 25 mm and 70 mm.

5. A sewing yarn according to claim 4, characterized in that the individual fibres of the spun fibre yarn covering have a mean staple length of between 33 mm and 43 mm.

6. A sewing yarn according to claim 1, characterised in that the total titre of the fibres of the second yarn component varies between 25 dtex and 200 dtex.

7. A sewing yarn according to claim 1, characterised in that each roving yarn has a total titre of between 70 dtex and 400 dtex.

8. A sewing yarn according to claim 1, characterised in that two to four roving yarns are twisted together with one another to form the sewing yarn.

9. A sewing yarn according to claim 1, characterised in that the first multifilament yarn component, forming the core, consists of polyester.

10. A sewing yarn according to claim 9, characterized in that the polyester is high strength polyester.

11. A sewing yarn according to claim 1, characterised in that the multifilaments of the first yarn components has an individual filament titre of between 1 dtex and 6 dtex.

12. A sewing yarn according to claim 11, characterized in that the multifilaments of the first yarn components have an individual filament titre of between 1.5 dtex and 3 dtex.

13. A sewing yarn according to claim 1, characterised in that the first multifilament yarn component has an individual filament count of between 16 and 300.

14. A sewing yarn according to claim 13, characterized in that the first multifilament yarn component has an individual filament count of between 24 and 96.

15. A sewing yarn according to claim 1, characterised in that the second yarn component is a fibre yarn made of polyester and/or of cellulosic fibres.

16. A sewing yarn according to claim 15, characterized in that the cellulosic fibres are cotton fibres.

17. A sewing yarn according to claim 1, characterised in that the fibres of the second yarn component has an individual fibre titre of between 0.6 dtex and 4 dtex.

18. A sewing yarn according to claim 17, characterized in that the fibres of the second yarn component have an individual fibre titre of between 0.8 dtex and 2 dtex.

19. A sewing yarn according to claim 1, characterised in that each roving yarn comprises a mass ratio of the first yarn component to the second yarn component of 50:50 to 75:25.

20. A sewing yarn according to claim 19, characterised in that each roving yarn comprises a mass ratio of the first yarn component to the second fibre yarn component of 58:42 to 68:32.

21. A sewing yarn according to claim 1, characterised in that the first yarn component and the second fibre yarn components of each roving yarn is made of the same fibre substrate.

22. A sewing yarn according to claim 1, characterised in that the specific strength of the roving yarn varies between 40 cN/tex and 55 cN/tex.

23. A sewing yarn according to claim 1, characterised in that the absolute strength of the roving yarn is between 320 Cn and 2,400 cN.

24. A sewing yarn according to claim 23, characterised in that the loop strength of the roving yarn amounts to between 60% and 70% of the absolute strength.

* * * * *